US009138127B2

(12) United States Patent
Bennett

(10) Patent No.: US 9,138,127 B2
(45) Date of Patent: Sep. 22, 2015

(54) ILLUMINATORY POWER BAND FOR A SHOE CLEANING DEVICE

(71) Applicant: Jethro Bennett, Cambridge (GB)

(72) Inventor: Jethro Bennett, Cambridge (GB)

( * ) Notice: Subject to any disclaimer, the term of this patent is extended or adjusted under 35 U.S.C. 154(b) by 146 days.

(21) Appl. No.: 13/769,249

(22) Filed: Feb. 15, 2013

(65) Prior Publication Data

US 2013/0212818 A1 Aug. 22, 2013

Related U.S. Application Data

(62) Division of application No. 13/273,005, filed on Oct. 13, 2011, now Pat. No. 8,578,541.

(30) Foreign Application Priority Data

Oct. 14, 2010 (GB) ..... 1017367
Aug. 4, 2011 (GB) ..... 1113439

(51) Int. Cl.
*A47L 23/02* (2006.01)
*A47L 23/06* (2006.01)

(52) U.S. Cl.
CPC ..... *A47L 23/02* (2013.01); *A47L 23/06* (2013.01); *Y10T 29/49826* (2015.01)

(58) Field of Classification Search
CPC .... A47L 23/02; A47L 23/06; Y10T 29/49826
USPC ..... 15/97.1, 97.2, 93.1, 236.1, 28
See application file for complete search history.

(56) References Cited

U.S. PATENT DOCUMENTS 4,432,112 A * 2/1984 Muller et al. ..... 15/36
6,954,961 B2 * 10/2005 Ferber et al. ..... 15/22.1
8,226,662 B2 * 7/2012 Song ..... 606/131

* cited by examiner

*Primary Examiner* — Shay Karls

(57) ABSTRACT

A shoe cleaning device 10 comprises a rotatable cleaning disc 12, a housing 14 for mounting the cleaning disc 12 on, a motor 16 for driving the disc 12 rotatably, and an illuminatory power band 210, the power band 210 itself comprising at least one light-emitting element 212, and at least one outer screen 214 for the at least one light-emitting element 212, the illuminatory power band 210 spanning a circumference of the device 10 at least one of totally, substantially, in pattern, the illuminatory power band 210 thus being visible from all angles for a user. In a preferred embodiment, the power band 210 is located about a base of the housing 14, and may have multiple light-emitting elements 212 and screens 214. The power band 210 may work in conjunction with a pressure-activated function of the shoe cleaning device 10. In a second embodiment which does not span a circumference of the device 10, the power band 210 is at least 16 mm in dimension, and more preferably at least 25 mm.

23 Claims, 4 Drawing Sheets

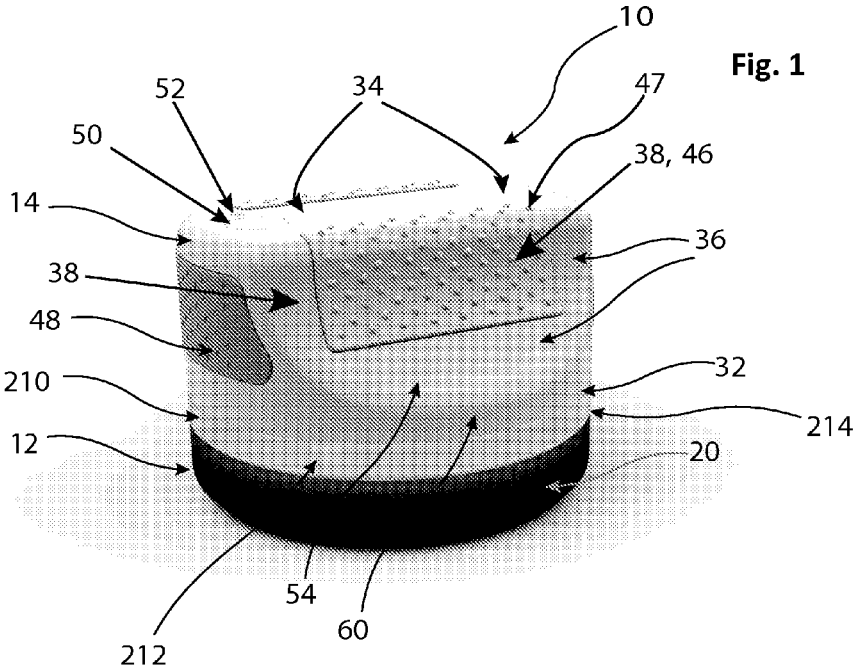
Fig. 1
Fig. 2
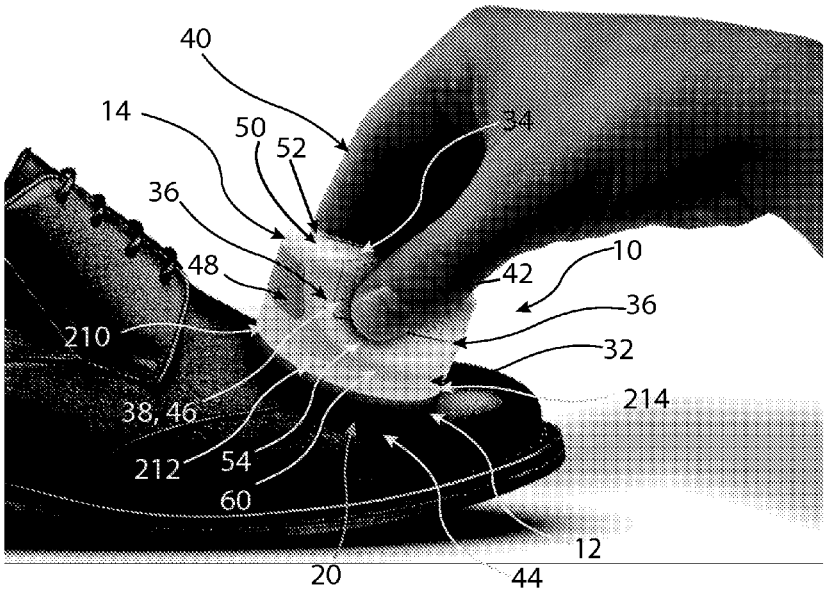

ILLUMINATORY POWER BAND FOR A SHOE CLEANING DEVICE

CROSS REFERENCE TO RELATED APPLICATIONS

The present application is a divisional of application U.S. Ser. No. 13/273,005, filed Oct. 13, 2011, the priority of which is hereby claimed, U.S. Ser. No. 13/273,005 in turn claiming priority to application GB1017367.2, filed Oct. 14, 2010, the priority of which is also hereby claimed. U.S. Ser. No. 13/273,005 also claims priority to GB1113439.2, filed Aug. 4, 2011, the priority of which is also hereby claimed.

The present invention relates to a power band for a shoe cleaning device. x

Electric shoe polishers have a significant lack of innovative features.

They don't have the naturally stimulatory interface that an electric toothbrush or an electric razor have, which naturally stimulate the skin of a user.

Thus whilst electric counterparts of toothbrushes and razors have generated multi-billion dollar worldwide sales in the morning cleanliness sector, electric shoe cleaning devices are barely used or considered by consumers, who often resort to cleaning their shoes with a portable non-electric sponge applicator, which has a squeezable housing so that a cleaning fluid inside may be squeezed onto the sponge and applied to a shoe. The problem is, a sponge applicator often does not shine the shoe. Instead of cleaning and buffing the shoe, it often applies a veneer of fluid agent that colours the surface of the shoe, thus coating it. Over time, this can affect the finish of the shoe, and is not suitable for high quality leather finishes.

Some may say that it is down to expense that electric shoe polishers are barely used and bought by consumers; however, an electric toothbrush is far more expensive than its non-electric counterpart; an electric razor is far more expensive than its non-electric counterpart.

Some may say it is down to effectiveness; but it is not particularly difficult to attach a powerful motor to a cleaning disc.

Thus it seems that it is a lack of a stimulatory and well-designed interface that is a key factor in a lack of desire for an electric shoe cleaning device.

The present invention seeks to provide a solution to these problems, by providing, in accordance with a first aspect of the invention, a shoe cleaning device, comprising a rotatable cleaning disc, a housing for mounting the cleaning disc on, a motor for driving the disc rotatably, and an illuminatory power band, the power band itself comprising a light-emitting element and an outer screen for the light-emitting element, the illuminatory power band spanning a circumference of the device at least one of: totally; substantially; in pattern, the illuminatory power band thus being visible from all angles for a user.

The illuminatory power band may be furtherly less obscured when in use by a user by being provided about a base of a housing of the shoe cleaning device, and in a preferred embodiment, has multiple light-emitting elements for lighting the power band, feasibly having multiple outer screens for the multiple light-emitting elements, the power band thus being split into multiple illuminating members.

The device may further have circuitry configured for stimulatory feedback for a user via the illuminatory power band, such as, for example but not essentially, lighting the power band when the device is activated, the power band being lit most preferably substantially simultaneously to the device being activated for cleaning of a shoe, the cleaning disc thus being driven and the illuminatory power band thus being illuminated substantially simultaneously.

In a preferred embodiment, the circuitry may be further configured for flashing the illuminatory power band, most preferably to communicate to a user that the device requires charging, and may be configured for lighting any of the lights of the power band independently, most preferably in a sequence-preferably to communicate to a user that charging of the device is taking place.

The device may be pressure activated, which may work in conjunction with all the aforementioned features. Preferably this is achieved via pressure applied about the housing of the device by a user, creating an intuitive and stimulatory interface for a user.

In a particular embodiment of the device, in no way limiting a scope of the present invention, and configured for extreme compactness, the motor of the shoe cleaning device may be mounted sideways within the housing to maintain an extreme low profile and there may be provided a non-centrally configured gearbox to maintain an extreme compact diametric profile.

Nevertheless, any shoe cleaning device may employ the illuminatory power band.

It is feasible that one large illuminating member that does not span a circumference of the device may itself act as a variable feedback illuminatory power band, in which case, it is of at least 16 mm in dimension.

Thus, according to a second aspect of the invention, there is provided a shoe cleaning device, comprising, a rotatable cleaning disc, a housing for mounting the cleaning disc on, a motor for driving the cleaning disc rotatably, a rechargeable battery for powering the device, an illuminatory power band, said illuminatory power band itself comprising, multiple light-emitting elements and at least one outer screen for the multiple light-emitting elements, the illuminatory power band being at least 16 mm in length, the device further comprising a pressure-activated surface, the pressure activated surface being provided about the housing of the device, the motor, (and thus the device), thus being activatable via pressure to the device by a hand of a user on the housing, and circuitry configured for at least two of: illuminating the illuminatory power band when the pressure-activated surface is pressurized for activating the motor, rotating of the cleaning disc and illuminating of the power band thus being substantially simultaneously initiated via pressure to the pressure activated surface, the power band thus communicating to a user that the device is activated for rotational cleaning of a shoe; flashing, the illuminatory power band thus being flashable; and independent lighting of the light-emitting elements of the power band, the illuminatory power band thus providing variable feedback responses for a user.

More preferably the illuminatory power band is at least 25 mm in length, thus providing further stimulatory feedback for a user.

The present invention will now be more particularly described, with reference to the accompanying drawings, by way of example and in no way limiting the scope of the invention, in which:

FIG. 1 is a perspective view of a shoe cleaning device according to a first aspect of the invention, where an illuminatory power band spans a circumference of the device in totality;

FIG. 2 is a demonstrational view of the device when in action, demonstrating a same embodiment of the illuminatory power band when in use;

FIGS. 1, 2, 3, 4, and 6 show the illuminatory power band when in use with a shoe cleaning device that is specifically configured to be extremely compact both in height and in diameter. Nevertheless, an illuminatory power band may be used with any shoe cleaning device.

Figure 3:
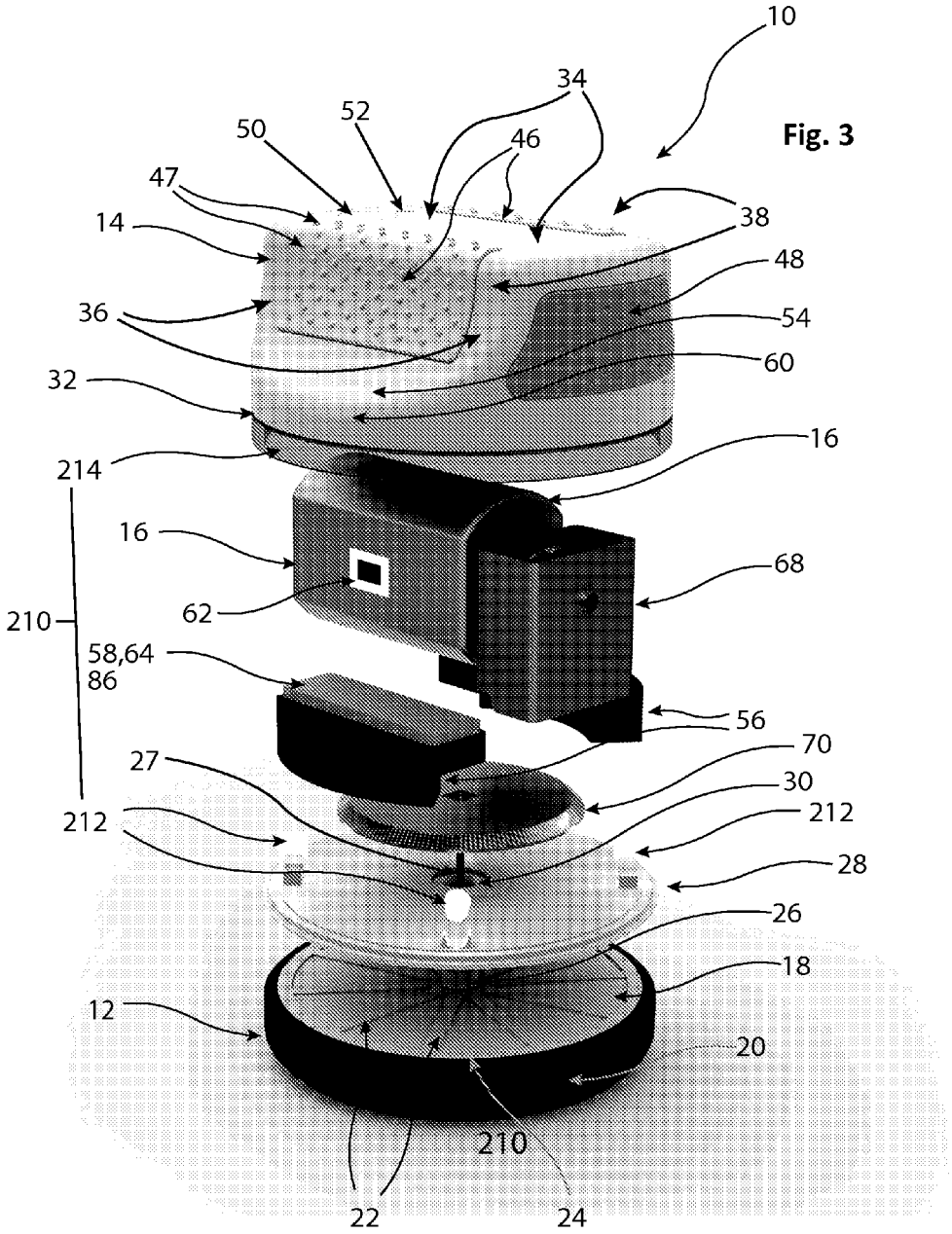
FIG. 3 is an exploded view of a shoe cleaning device that uses the illuminatory power band, displaying features of the power band and device in isolation.

Referring to the drawings, and particularly referring to an embodiment of a shoe cleaning device as depicted in FIG. 1, FIG. 2 and FIG. 3, there is shown a shoe cleaning device 10 which comprises a rotatable cleaning disc 12, a housing 14 on which the cleaning disc 12 is rotatably mountable, a horizontally mounted motor 16, mounted sideways within the housing 14 to maintain an extreme low profile, and a non-centrally configured gearbox 68, non-central to a central axis of the cleaning disc 12, non-centrally configured to allow the sideways mounted motor 16 to be housed within, or substantially within a circumference of the cleaning disc 12, the device thus maintaining both an extreme low profile and an extreme compact diametric profile.

Extreme low profile refers to an extreme low height of the device 10. Extreme compact diametric profile refers to an extremely compact diameter of the device 10.

The disc 12 has a, typically plastics, base 18 and a cleaning element 20. The base 18 may conveniently include radial spokes 22 that extend to a rim 24. The cleaning element 20 may be attached permanently to the, typically plastics, base 18 with resin or glue type materials, or may fit to the base 18 by overlapping the disc rim 24. In this way, it is feasible that a common base 18 may be used for selectable cleaning elements 20, which may reduce cost. In a preferred embodiment a base 18 is singular to each separate cleaning element 20, forming a cleaning disc 12 that is interchangeably selectably mountable.

The disc 12 may be mountable to the housing 14 via a central attachment point 26 that may attach to a central drive shaft 27. The drive shaft 27 may be sheathed or collared as it is received by the central attachment point 26, thus rotating the cleaning disc 12. The disc 12 and/or the cleaning element 20 may be hollowed at its centre as the outer perimeter of a rotating cleaning disc rotates at a higher speed.

The housing 14 has a base 28 that has a central aperture 30. There is shown a circular outer housing rim 32, the housing rim 32 having the same or substantially similar circumference as the disc 12. The housing 14 houses a horizontally mounted motor 16, mounted sideways within the housing to maintain an extreme low profile. The housing 14 encapsulates the motor 16, thus forming a narrow plain 34 on top of the motor 16 and a scalloped recess 36 on either side of the motor 16. The narrow plain 34 and the scalloped recess 36 together form a mounded pinchgrip 38 that a user may pinch between their fingers 40, or, most preferably, between two fingers 40 and a thumb 42. As shown in FIG. 2, the user may thus pinch the mounded pinchgrip 38, operating the device and simultaneously applying downward pressure to a shoe surface 44.

Preferably on either side of the mounded pinchgrip 38 there is provided a, preferably rubberized, layer of higher friction material 46 or a higher friction surface, which aids gripping of the shoe cleaning device 10. The higher friction material 46 may have pips or projections 47 to further aid gripping of the device 10. A second higher friction material layer 48 or higher friction surface may be provided on opposing ends of the narrow plain 34 so that a user may grip the shoe cleaning device 10 without squeezing the mounded pinchgrip 38.

A depressible booster button 50 is conveniently located on top of the narrow plain 34, and a lighting means 52 beside the booster button 50 indicates its activation. It is feasible that other means of boosting the speed of the rotatable cleaning disc 12 may be provided, such as buttons or switch members, or any other booster selecting element, which will be apparent to persons with skill in the art.

The scalloped recess 36 arcuates to a raised housing portion 54, in which various housing components reside, there being housed a, preferably lithium ion rechargeable, battery 56 and a PCB 58. The battery 56 may be present within both raised housing portions 54, either separately offering power to the shoe cleaning device 10 or centrally linked, thus forming one battery unit. Lithium ion battery constitution allows for batteries to be of unorthodox shape, thus aiding efficiency of the device 10 by maximising the shape and power of a battery 56 to fit within the housing 14.

The raised housing portion 54 conveniently tapers round to the housing rim 32 via an arcuate curve 60.

Pinching of the mounded pinchgrip 38 by a user may activate the motor 16 and therefore the shoe cleaning device 10 via pressure to a pressure activated unit 62 which may conveniently be attached to a side of the motor 16. This is controlled by an activation circuit 64. Differential pressure to the pinchgrip 38 by a user may result in differential speed or power output to the cleaning disc 12.

The horizontally mounted motor 16 has a motor drive shaft which is non-central to a central axis of the cleaning disc 12, thus requiring a non-centrally configured gearbox 68. The gearbox 68 forms a gearing solution that includes a, preferably bevel or crown, gear 70 that routes the axis of rotation back to a central axis via a non-central geartooth connection thus rotating the rotatable cleaning disc 12. The, preferably bevel or crown, gear 70 may be internal or external to the housing 14.

It is feasible that the cleaning disc base 18 has a gear tooth configuration that receives a, preferably bevel, non-central gear from the non-centrally configured gearbox 68 via a non-central aperture in the housing base 28. In this case, the cleaning disc 12 may be mountable to the housing base 28 via a free spinning axial shaft that may be sheathed or collared, the disc itself acting as a gear.

In a preferred embodiment, the housing features an illuminatory power band 210 that spans a circlic circumference of the device 10 and comprises a, preferably plastics, outer screen 214 and multiple LED lights 212 that are controlled by a lighting circuit 86. It is feasible that it may be lighted by other means that will be apparent to those skilled in the art. It may span the circumference of the device 10 in totality or in pattern, and provides variable response outputs to a user, which include being illuminated, being non-illuminated, flashing, and illuminating in a preferably circlic sequence.

Preferably the illuminatory power band 80 provides feedback such as flashing during use to indicate the device 10 requires recharging, and separate lighting members 84 and/or illuminating members 104 lighting in a, preferably cyclical, sequence to denote when the device 10 is recharging.

Referring to FIG. 2 there is shown the shoe cleaning device 10 as the mounded pinchgrip 38 is being pinched by a user. At least one pressure activated unit 62 is conveniently attached to the motor 16 so that pressurizing of the mounded pinchgrip 38 may activate the device 10. The device 10 is approximately 50 mm in diameter, extremely compact for a shoe cleaning device, and more preferably 48 mm. Thus the device 10 maintains an extreme compact diametric profile. The housing 10 is approximately 30 mm in height, more preferably 27 mm; an extremely compact height for a shoe cleaning device. Thus the device 10 maintains an extreme low profile, with the cleaning disc 12 preferably being approximately 8 mm in height. In this way, the horizontally mounted motor 16 achieves an extreme low profile for a shoe cleaning device, without which the mounded pinchgrip 38 would become unintuitive.

The raised housing portion 54 defines a compartment that includes a lithium ion battery 56 and a PCB 58. The motor 16 drives the cleaning disc 12 via a non-centrally configured gearbox 68, and a, preferably bevel or crown, gear 70 that is central to a central axis of the cleaning disc 12.

Figure 4:
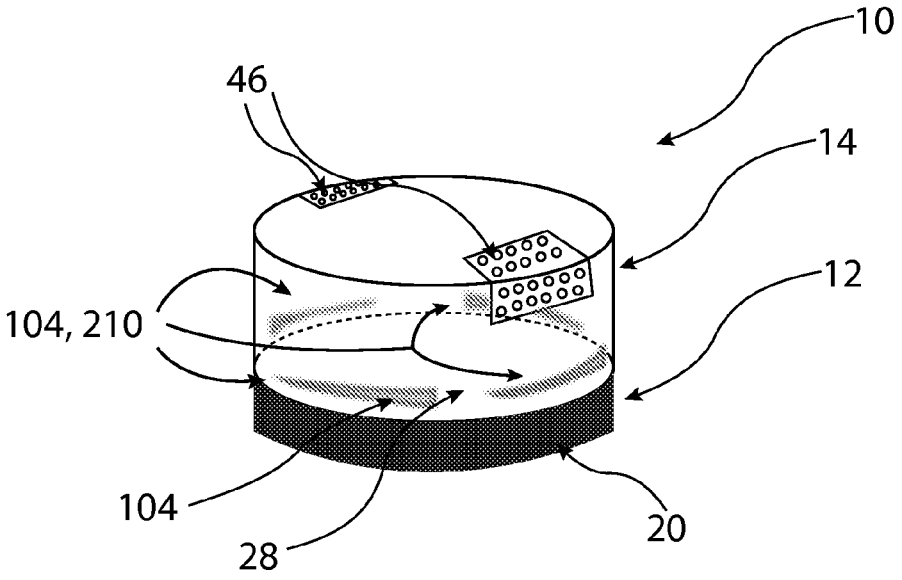
FIG. 4 is a perspective view of a shoe cleaning device that has an illuminatory power band with multiple light-emitting elements and multiple outer screens for the light-emitting elements.
Figure 5:
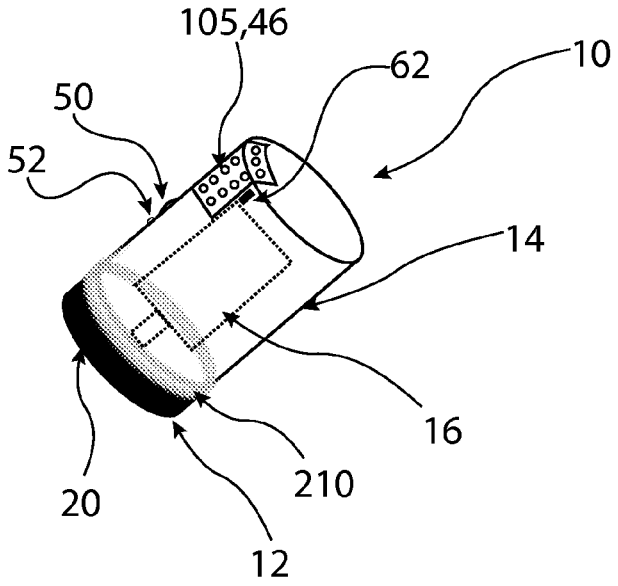
FIG. 5 is a perspective view of a more standard embodiment of a shoe cleaning device that uses an illuminatory power band, thus showing that any shoe cleaning device may use the illuminatory power band.

Referring to FIGS. 4 and 5, there is provided an illuminatory power band 210 that spans a circlic circumference of the device 10. Referring to FIG. 5, it spans the circumference in totality. Referring to FIG. 4, it spans the circumference in pattern, wherein separate illuminating members 104 are able to light in a sequence, thus performing the function of an illuminatory power band 210 that spans a circlic circumference in totality. In this separate illuminating member 104 configurement, there are preferably at least two illuminating members 104, and more preferably four. It is feasible that one large illuminating member 104 that does not span a circumference of the device 10 may act as a variable feedback illuminatory power band 210, in which case it is of at least 16 mm in dimension, more preferably at least 25 mm. Thus the cleaning device has an illuminatory power band that is at least one of: arranged in pattern; cyclic; greater than 16 mm in length; of multiple illuminating members.

Referring to FIG. 5, there is shown the illuminatory power band 210 where a motor 16 is vertically mounted, thus not requiring a non-centrally configured gearbox 68, the housing 14 forming a tube. An illuminatory power band 210 is provided that spans the circumference of the device 10 in totality, offering variable feedback responses as hereinbefore described. The housing 14 may feature a grip 105, which may conveniently have higher friction materials 46 or a higher friction surface to aid gripping by a user. The device 10 may feature a pressure activated unit 62 so that pressurising of the grip 105 may activate the device, thus activating rotation of the rotatable cleaning disc 12. Preferably the pressurising of the grip 105 also activates the illuminatory power band 210. A booster button 50 or switch member may feature on the housing 14, which may also feature a lighting means 52 which indicates its activation. Downward pressure may be exerted by a user as the device 10 is placed on and moved around a user's shoe. Variations of the embodiment may be provided that will be apparent to persons skilled in the art, such as a pressure activated grip 105 being provided on the top of the housing 14.

The illuminatory power band 210 offers variable feedback responses that significantly add to the intuitiveness of the device 10. As is shown in FIG. 2, the illuminatory power band 210 provides illumination when the device 10 is activated, preferably via pinching of a mounded pinchgrip 38 wherein there is a pressure activated unit 62 that may relay an electrical signal to an activation circuit 64 and a lighting circuit 86. Preferably the illuminatory power band 210 provides further feedback such as flashing during use to indicate the device requires recharging, and separate lighting-emitting elements 212 and/or illuminating members 104 lighting in a, preferably circlic, sequence to denote when the device 10 is recharging.

Figure 6:
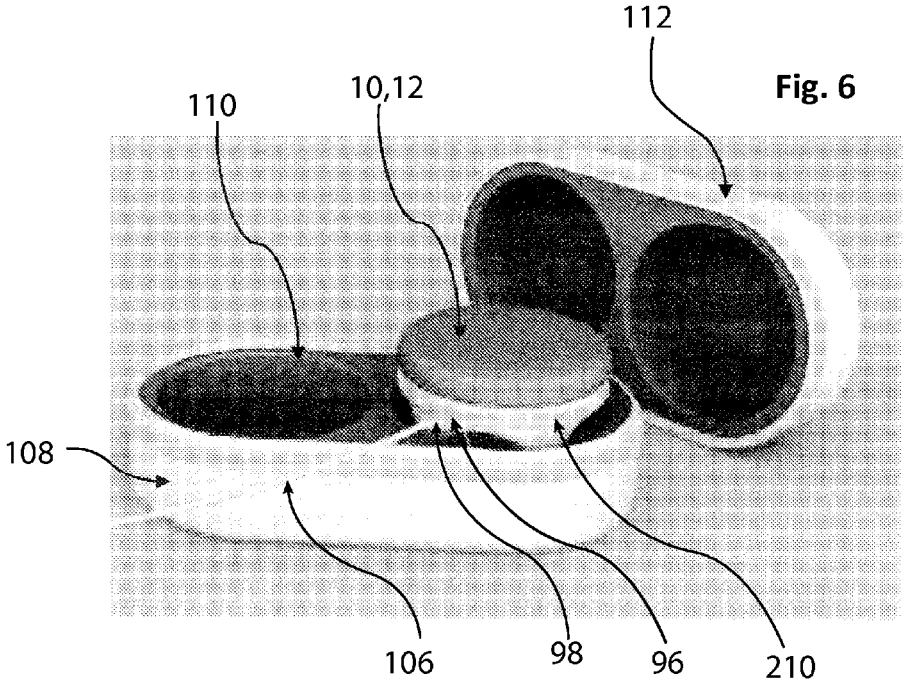
FIG. 6 is a perspective view of a shoe cleaning device that has the illuminatory power band and a recharging jack that interrupts the power band, the power band thus spanning a circumference of the device substantially.

Referring to FIG. 6, there is provided a recharging jack 98 for an input socket 96. The jack 98 may have a cable 106 so that the device 10 can be recharged via a mains electricity output or any other power output. The device 10 may be wirelessly rechargeable.

There is provided a storage container 108 which comprises a cavity 110, a lid 112 for closing the cavity 110, and a shoe cleaning device 10 substantially as hereinbefore described. The configuration of the container 108 is shown by way of example only. A container 108 may be of similar size to the embodiment here shown, and may have a different cavity 110 configuration, for example multiple cavities 110 to contain multiple shoe cleaning device accessories as well as the device 10.

In use, and with particular reference to an embodiment of a shoe cleaning device as shown in FIGS. 1, 2, 3, 4, and 6, (an illuminatory power band not being limited to being used with any one embodiment of a shoe cleaning device), the device 10 is picked up via the mounded pinchgrip 38, with a cleaning disc 12 being selected by the user, the cleaning disc 12 being one of a polishing disc, a buffing disc, and a brushing disc. A polishing substance 118 is applied to the cleaning element 20 by the user, although it is feasible a spray polish may be directly sprayed to a shoe. The device 10 may be twisted by the user on contact with the polishing substance 118 so that polish is applied to the disc 12. The device 10 may be gripped at adjacent ends to the mounded pinchgrip 38 preferably via a second higher friction materials 48 that aid gripping of the device 10. This avoids activation of the device 10 which is preferably activated by pinching of the pinchgrip 38.

A polishing disc is selected for polishing, a buffer disc for buffing, preferably after polishing, and a brushing disc is selected to remove dirt and particulate material that may prevent thorough shining of the shoe by the polishing disc. The brushing disc may feature bristles. A sprayer may be provided so that a water based fluid may be sprayed to the shoe to aid cleaning. In this way, a soccer boot, a golf shoe, or a walking boot may be cleaned and may also be prepared for polishing and buffing.

Different colour polishing discs may be provided for different colour polishes and shoes, such as brown or black. The appropriate disc 12 is attached. The mounded pinchgrip 38 is preferably pinched by two fingers 40 and a thumb 42. Pressure can thus be exerted directly downwards onto a shoe surface 44 as it is placed on and around a user's shoe whilst retaining intuitive and perfect control of the device 10 simply by pinching.

If more polish is required, the device 10 may again be pinched by the user at the opposing ends of the mounded pinchgrip 38, aided by the second higher friction material 48 or higher friction surface. Thus the user can easily apply polish 118 during the act.

The selected disc 12 may be unselected and detached by the user by various means that will be apparent to persons skilled in the art, such as unclipping. It may be possible for a disc 12 to be selectably attached by a user simply by applying pressure to it at an angle by which a central drive shaft 27 is received by a central attachment point 26, so that the disc 12 need never be held by the user.

The device 10 is preferably activated by pinching of the mounded pinchgrip 38 by the user, which preferably illuminates an illuminatory power band 80 that spans a circumference of the device 10 in totality or in pattern. The illuminatory power band 80 offers variable feedback responses to the user, illuminating when the device 10 is activated, flashing when the device requires recharging to the battery 56, and lighting in a, preferably circlic, sequence to denote that charging is taking place. It may also alter sequence to denote that charging is complete, thus saving electrical power and/or alerting a user.

An ON/OFF button may feature on the housing 14. Preferably it is not provided as the device 10 is activated by pressure to the mounded pinchgrip 38 and/or pressure activated unit 62.

A booster button/switch member 50 may be pressed by the user to generate extra rotational speed for the cleaning disc 12. This may be particularly used for buffing. The combination of the softer buffing disc material, with increased rpm of the cleaning disc 12, and feasibly a fluid spray that is sprayed on to the shoe surface 44 may add shine to the shoe.

After use, the shoe cleaning device is stored in a container 108 which comprises a cavity 110 and a lid 112 for closing the cavity. The container 108 has at least one cavity, which cavities may be used to store at least one selectably mountable discs 12, at least one shoe polishing unit container which comprises a cavity, a polishing substance and a lid for closing the cavity, and a shoe cleaning device 10 as hereinbefore described. Other accessories may be included.

The container 108 closes, and, along with the compactness of the device 10, made possible by the horizontally mounted motor 16, allows full portability of the device 10 with polishing accessories. Preferably the lid 112 clips to the base of the container 108 or is magnetically attachable.

The device 10 is recharged by the user either via a recharging jack 98, or wirelessly, which may activate a relevant lighting sequence from the illuminatory power band 210. Preferably the battery 56 offers at least 10 minutes use when fully recharged, or significantly more, thus ensuring the portability of the device 10.

The higher friction layer aids grip of the device and enhances it.

The pressure activated unit offers a surprising and interactive interface for the user and further enhances the mounded pinchgrip which, on top of the aforementioned abilities, allows a user to activate the device without the need for an ON/OFF button, further enhancing the intuitiveness and accessibility of the device.

The illuminatory power band offers unparalleled feedback for a shoe cleaning device and enhances the experience by providing a communicative interface.

The device may come in differing colours, such as a black matt plastic finish with a green illuminatory power band or in colours which may be gender specific, such as a white plastic finish with a pink power band.

All features combined, the device offers a unique interface that is personalised, communicative and puts the shoe cleaning device 10 on a par with other technologies in the personal grooming sector.

The design and technical features mean that, for the first time, a user can proudly shine their shoes with a portable electric shoe cleaning device that is highly efficient, and on a par with modern technology.

Due to the extreme compactness and portability of the device, accessories such as polishing unit containers and cleaning discs can be carried in the storage container, whilst retaining portability. Preferably the polishing unit containers are of plastics materials, remaining lightweight. With the configuration of the opposing ends of the mounded pinchgrip that are not pressure-activated, and preferably have a layer of higher friction material to aid gripping, a user can apply polish without ever being concerned of getting polish on their hands-a key concern to many potential buyers, who perceive shoe shining to be a messy pastime. A clippable attachment means for the discs may further enhances efficacy.

An illuminatory power band is in no way limited to any one embodiment of a shoe cleaning device, being usable with any shoe cleaning device, which will be obvious to those with skill in the art.

The embodiments described above are provided by way of example only, and various other modifications will be apparent to persons skilled in the art without departing from the scope of the invention as defined by the appended claims.

The invention claimed is:

1. A cleaning device, comprising:
a motor-driven cleaning element;
a housing for mounting the cleaning element on;
a motor for driving the cleaning element; and
an illuminatory power band, the power band itself comprising:
at least one light-emitting element; and
at least one outer screen for the at least one light-emitting element,
the illuminatory power band spanning a circumference of the device at least one of:
totally;
substantially;
in pattern,
the illuminatory power band thus being visible from all angles for a user;
wherein the cleaning device is pressure activated, motor of the device, and thus driving of the cleaning element, being activated via pressure applied to the housing by a user; and
wherein at least one light-emitting element of the power band is illuminated substantially simultaneously to the motor being activated, the illuminatory power band thus being illuminated substantially simultaneously to the motor being activated, illuminating of at least one of the light-emitting elements of the illuminatory power band, and activation of the motor for driving the cleaning element, thus being substantially simultaneously activated via pressure applied to the housing of the device by the user, the illuminatory power band thus providing a stimulatory interface, and communicative feedback for a user.

2. A cleaning device as claimed in claim 1, wherein the device comprises at least one of:
a pressure activated unit to facilitate pressure-activation;
a pressure activated surface to facilitate pressure-activation.

3. A cleaning device as claimed in claim 1, wherein a whole of the illuminatory power band is illuminated substantially simultaneously to the motor being activated.

4. A cleaning device as claimed in claim 1, wherein the device comprises circuitry configured to illuminate the illuminatory power band in a circlic sequence to denote to a user that the device is recharging.

5. A cleaning device as claimed in claim 4, wherein the device comprises circuitry configured to flash the illuminatory power band to indicate the device requires recharging.

6. A cleaning device as claimed in claim 1, wherein the device is a shoe cleaning device, and the cleaning element is a rotatable cleaning disc driven rotatably by the motor.

7. A cleaning device, comprising:
a motor-driven cleaning element;

a housing for mounting the cleaning element on;
a motor for driving the cleaning element; and
an illuminatory power band, the power band itself comprising:
at least one light-emitting element; and
at least one outer screen for the at least one light-emitting element,
the illuminatory power band spanning a circumference of the device at least one of:
totally;
substantially;
in pattern,
the illuminatory power band thus being visible from all angles for a user;
wherein an axis about which the illuminatory power band surrounds the housing, and pointing direction of the cleaning element, are substantially matched in alignment.

8. A cleaning device as claimed in claim 7, wherein the illuminatory power band is provided about a base area of the housing of the device, the base area being a low portion of the housing, close in proximity to the motor-driven cleaning element.

9. A cleaning device as claimed in claim 7, wherein the illuminatory power band is located directly above the cleaning element, and the axis about which the illuminatory power band surrounds the housing travels directly through a centre of the cleaning element.

10. A cleaning device as claimed in claim 9, wherein a circumference of the illuminatory power band and a circumference of the cleaning element are substantially the same.

11. A cleaning device as claimed in claim 7, wherein the housing, and thus the illuminatory power band, do not significantly extend outside a circumference of the cleaning element.

12. A cleaning device as claimed in claim 7, wherein the device is a shoe cleaning device, and the cleaning element is a rotatable cleaning disc driven rotatably by the motor.

13. A shoe cleaning device, comprising:
a rotatable cleaning disc;
a housing for mounting the cleaning disc on;
a motor for driving the cleaning disc rotatably;
a rechargeable battery for powering the device;
an illuminatory power band, said illuminatory power band itself comprising:
at least one light-emitting element; and
at least one outer screen for the at least one light-emitting element, the illuminatory power band being at least 16 mm in length;
a pressure-activated surface, the pressure activated surface being provided about the housing of the device, the motor, and thus the device, thus being activatable via pressure to the device by a hand of a user on the housing;
wherein at least one light-emitting element of the illuminatory power band is illuminated when the pressure-activated surface is pressurized for activating the motor, rotating of the cleaning disc and illuminating of the power band thus being substantially simultaneously initiated via pressure to the pressure activated surface, the power band thus communicating to a user that the device is activated for rotational cleaning of a shoe;
wherein the housing of the device does not significantly extend outside a circumference of the cleaning disc.

14. A shoe cleaning device as claimed in claim 13, wherein the circumference of the cleaning disc and a circumference of the housing are substantially the same.

15. A shoe cleaning device as claimed in claim 13, wherein the illuminatory power band, previously defined as being at least 16 mm in length, is furtherly limited to being at least 25 mm in length.

16. A shoe cleaning device as claimed in claim 13, wherein a whole of the power band is illuminated substantially simultaneously to activation of the motor, and thus the device.

17. A shoe cleaning device as claimed in claim 13, wherein the illuminatory power band comprises multiple light-emitting elements, and the device comprises circuitry configured to light the light-emitting elements of the illuminatory power band in a sequence, to denote to a user that charging is taking place.

18. A shoe cleaning device as claimed in claim 17, wherein the device comprises circuitry configured to flash the illuminatory power band to indicate the device requires recharging.

19. A shoe cleaning device as claimed in claim 13, wherein the housing comprises a pressure activated grip with higher friction surface, to activate the motor and illuminatory power band substantially simultaneously.

20. A shoe cleaning device as claimed in claim 13, wherein the housing comprises a pressure activated grip on a top of the housing, to activate the motor and illuminatory power band substantially simultaneously.

21. A handheld cleaning device, comprising:
a motor-driven cleaning element;
a housing for mounting the cleaning element on;
a motor for driving the cleaning element; and
an illuminatory power band, the power band comprising at least one light-emitting element and spanning a circumference of the device at least one of:
totally;
substantially;
in pattern,
the illuminatory power band thus being visible from all angles for a user;
wherein the device comprises circuitry configured so that the illuminatory power band lights up in a circlic sequence to denote recharging.

22. A handheld cleaning device as claim in claim 21, wherein the illuminatory power band comprises a plurality of light-emitting elements, the device configured to light the light-emitting elements in a circlic sequence to denote charging.

23. A handheld cleaning device as claim in claim 22, wherein the illuminatory power band comprises separate sections, the separate sections independently lightable, each section comprising at least one light-emitting element.

* * * * *